US012038195B2

(12) United States Patent
Zhang et al.

(10) Patent No.: US 12,038,195 B2
(45) Date of Patent: Jul. 16, 2024

(54) AIR CONDITIONING SYSTEM

(71) Applicant: GREE ELECTRIC APPLIANCES, INC. OF ZHUHAI, Guangdong (CN)

(72) Inventors: Shiqiang Zhang, Guangdong (CN); Lianfa Wu, Guangdong (CN); Limin Li, Guangdong (CN); Huachao Jiao, Guangdong (CN); Tao Feng, Guangdong (CN); Bing Zhou, Guangdong (CN); Peng Cao, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 267 days.

(21) Appl. No.: 17/283,479

(22) PCT Filed: Dec. 14, 2018

(86) PCT No.: PCT/CN2018/121138
§ 371 (c)(1),
(2) Date: Apr. 7, 2021

(87) PCT Pub. No.: WO2020/073481
PCT Pub. Date: Apr. 16, 2020

(65) Prior Publication Data

US 2022/0011014 A1 Jan. 13, 2022

(30) Foreign Application Priority Data

Oct. 8, 2018 (CN) ..... 201811168921.3

(51) Int. Cl.
*F24F 13/30* (2006.01)
*F24D 17/00* (2022.01)
(Continued)

(52) U.S. Cl.
CPC ..... *F24F 13/30* (2013.01); *F24D 17/0005* (2013.01); *F24F 3/065* (2013.01);
(Continued)

(58) Field of Classification Search
CPC ..... F24F 13/30; F24F 11/84; F24F 3/065; F24F 5/0096; F24D 17/0005; F24D 2200/31;
(Continued)

(56) References Cited

U.S. PATENT DOCUMENTS 6,293,118 B1 9/2001 Oh
6,293,119 B1 9/2001 Wenzel
(Continued)

FOREIGN PATENT DOCUMENTS

CN 1155643 7/1997
CN 1155643 A 7/1997
(Continued)

OTHER PUBLICATIONS

Lin et al., Multiple Heat Pump Air Conditioning Water Heater, Oct. 28, 2009, CN101566403A, Whole Document (Year: 2009).*
(Continued)

*Primary Examiner* — Larry L Furdge
(74) *Attorney, Agent, or Firm* — Fish & Richardson P.C.

(57) ABSTRACT

An air conditioning system, comprising an outdoor unit and an indoor heat exchange mechanism. The indoor heat exchange mechanism comprises an air conditioner indoor unit and a first heat exchange mechanism used for at least one among water cooling, water heating and space heating. The present air conditioning system integrates various functions into one, such as air-conditioning refrigeration, air-conditioning heating, producing household cold water, producing household hot water, and home heating by means of connecting indoor units for cooling and heating, a water cooling mechanism, a water heating mechanism and a
(Continued)

device for floor heating located indoors to one outdoor unit. Moreover, the system directly utilizes high-temperature refrigerant to heat water for floor heating.

9 Claims, 1 Drawing Sheet

(51) Int. Cl.

| | |
|---|---|
| ***F24F 3/06*** | (2006.01) |
| ***F24F 5/00*** | (2006.01) |
| ***F24F 11/84*** | (2018.01) |
| ***F25B 13/00*** | (2006.01) |

(52) U.S. Cl.
CPC ..... *F24F 5/0096* (2013.01); *F24F 11/84* (2018.01); *F25B 13/00* (2013.01); *F24D 2200/31* (2013.01); *F25B 2313/02741* (2013.01); *F25B 2600/25* (2013.01)

(58) Field of Classification Search
CPC ..... F25B 13/00; F25B 2313/02741; F25B 2600/25
See application file for complete search history.

(56) References Cited

U.S. PATENT DOCUMENTS

| | | | | |
|---|---|---|---|---|
| 2009/0133435 | A1 * | 5/2009 | Toyoshima ..... | F25B 43/006 62/473 |
| 2021/0080137 | A1 | 3/2021 | Zhang et al. | |

FOREIGN PATENT DOCUMENTS

| | | | | |
|---|---|---|---|---|
| CN | 101131246 | | | 2/2008 |
| CN | 101566403 | | | 10/2009 |
| CN | 101566403 | A | * | 10/2009 |
| CN | 101592420 | | | 12/2009 |
| CN | 101592420 | A | | 12/2009 |
| CN | 101644508 | | | 2/2010 |
| CN | 101644508 | A | | 2/2010 |
| CN | 201748704 | | | 2/2011 |
| CN | 102425882 | A | * | 4/2012 |
| CN | 102770725 | | | 11/2012 |
| CN | 102770725 | A | | 11/2012 |
| CN | 203940562 | | | 11/2014 |
| CN | 203940562 | U | | 11/2014 |
| CN | 107178833 | | | 9/2017 |
| CN | 108019808 | | | 5/2018 |
| CN | 108489134 | | | 9/2018 |
| CN | 108489134 | A | | 9/2018 |
| CN | 209084936 | | | 7/2019 |
| EP | 1371914 | | | 12/2003 |
| EP | 1703230 | | | 1/2011 |
| EP | 2450637 | | | 5/2012 |
| EP | 2047183 | | | 1/2014 |
| JP | H 0339870 | | | 2/1991 |
| JP | 2004226015 | A | * | 8/2004 |
| KR | 100589913 | B1 | * | 6/2006 |
| KR | 10-2010-0069402 | | | 6/2010 |
| KR | 20100069402 | A | | 6/2010 |
| WO | WO 2014103013 | | | 7/2014 |

OTHER PUBLICATIONS

Liang et al., Heat Recovery Multiple Heat Pump Air Condition . . . , Apr. 25, 2012, CN102425882A, Whole Document (Year: 2012).*
Kusaka, Air Conditioning Apparatus, Jun. 19, 2006, KR100589913B1, Whole Document (Year: 2006).*
Goto et al., Cold Water/Hot Water Feed System, Aug. 12, 2004, JP2004226015A, Whole Document (Year: 2004).*
International Search Report for PCT/CN2018/121138, mailed on Jun. 28, 2019. 2 pages.
PCT International Preliminary Report on Patentability in International Appln. No. PCT/CN2018/121138, dated Apr. 8, 2021, 9 pages (with English Translation).
PCT International Search Report and Written Opinion in International Appln. No. PCT/CN2018/121138, dated Jun. 6, 2019, 13 pages (with English Translation).
Extended European Search Report in European Appln No. 18936725, dated Jun. 2, 2022, 4 pages.
Office Action in Chinese Appln. No. 201811168921.3, dated Sep. 27, 2023, 16 pages (with English translation).

* cited by examiner

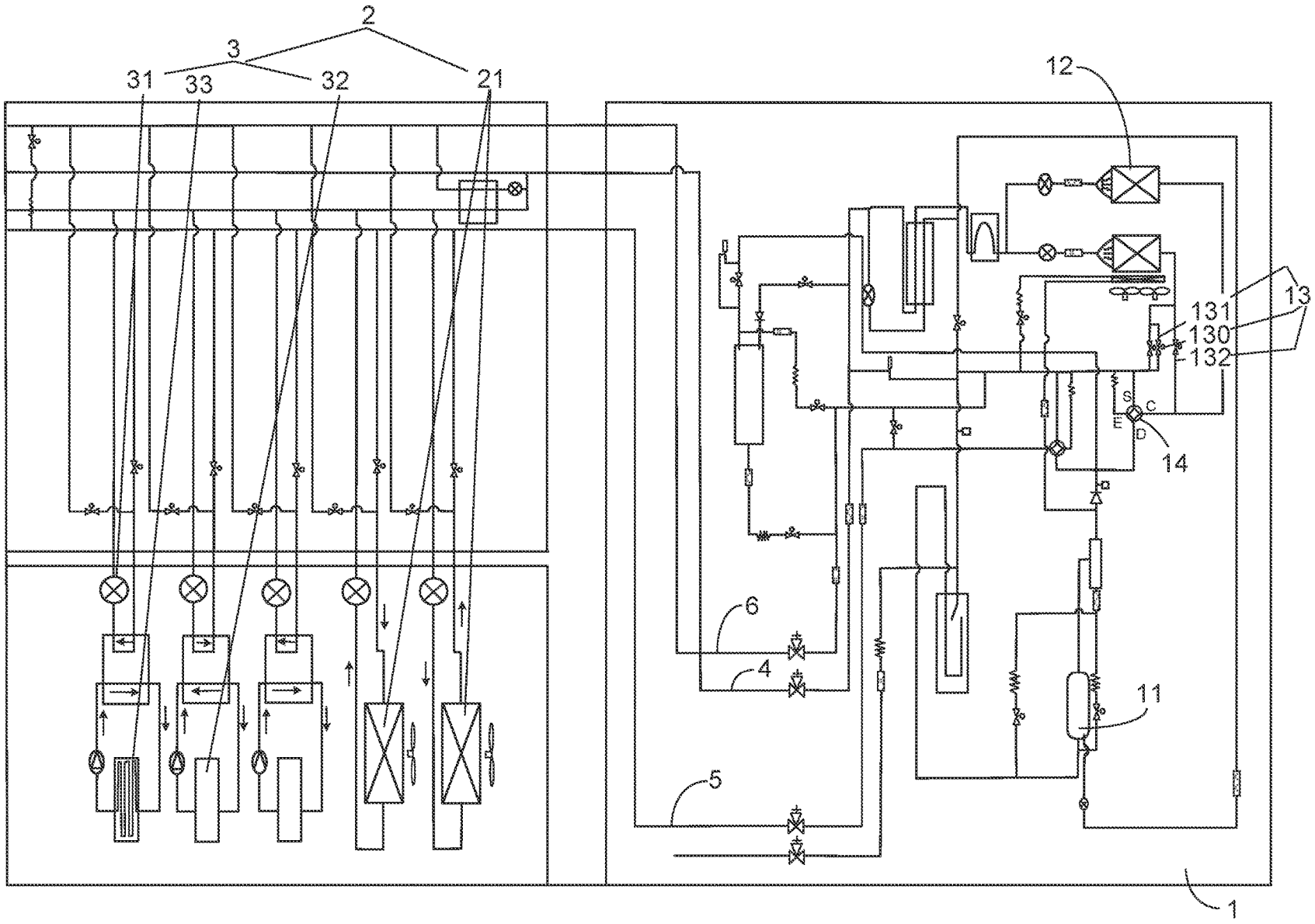
1
2
3
4
5
6
11
12
13
14
21
31
32
33
130
131
132
S
C
E
D

AIR CONDITIONING SYSTEM

CROSS-REFERENCE TO RELATED APPLICATIONS

The present application is a U.S. National Phase application under 35 U.S.C. § 371 of International Patent Application No. PCT/CN2018/121138, filed on Dec. 14, 2018, which claims priority to Chinese application No. 201811168921.3 filed on Oct. 8, 2018, the disclosure of which is hereby incorporated herein by reference in its entirety.

TECHNICAL FIELD

The present disclosure relates to the technical field of air treatment equipment, and more particularly, to an air conditioning system.

BACKGROUND

In the global multi-split air conditioner market, the heat recovery multi-split air conditioner is very popular with consumers in the North American and European Union markets. At present, the common heat recovery multi-split air conditioning systems on the market can only achieve two functions of cooling and heating at the same time. However, while cooling or heating, customers also have requirements for water cooling, water heating, and home heating. Therefore, the existing heat recovery multi-split air conditioning systems have the problem that it cannot meet the various needs of customers at the same time.

SUMMARY

In order to solve the technical problem that various needs of customers cannot be met, an air conditioning system that can meet various needs is provided.

An air conditioning system, including an outdoor unit and an indoor heat exchange mechanism, the indoor heat exchange mechanism is in communication with the outdoor unit via a liquid line, a high-pressure gas line and a low-pressure gas line, the indoor heat exchange mechanism includes an air conditioner indoor unit and a first heat exchange mechanism, and the first heat exchange mechanism is used for at least one of water cooling, water heating and space heating.

An air conditioning system, including an outdoor unit and various kinds of indoor heat exchange mechanisms, the indoor heat exchange mechanisms include an air conditioner indoor unit and at least one first heat exchange mechanism for water cooling, water heating, or heating. The indoor heat exchange mechanisms all communicate with the outdoor unit via a liquid line, a high-pressure gas line, and a low-pressure gas line, and the air conditioning system has a cooling mode in which the indoor heat exchange mechanism only for cooling is turned on, a heating mode in which the indoor heat exchange mechanism only for heating is turned on, and a hybrid mode in which the indoor heat exchange mechanism for cooling and the indoor heat exchange mechanism for heating are both turned on.

The outdoor unit includes a compressor, two outdoor heat exchange units, and a valve assembly, the high-pressure gas line is in communication with an exhaust port of the compressor, the low-pressure gas line is in communication with an intake port of the compressor, one of the outdoor heat exchange units has a third state in which one end is in communication with the high-pressure gas line and the other end is in communication with the liquid line, and a fourth state in which one end is in communication with the low-pressure gas line and the other end is in communication with the liquid line.

The other outdoor heat exchange units has a fifth state in which one end is in communication with the liquid line and the other end is in communication with the high-pressure gas line via the valve assembly, and a sixth state in which one end is in communication with the liquid line and the other end is in communication with the low-pressure gas line via the valve assembly, and the valve assembly is configured to control the outdoor heat exchange unit to switch between the fifth state and the sixth state.

The valve assembly includes a high-pressure solenoid valve and a low-pressure solenoid valve, the high-pressure solenoid valve forms a high-pressure inlet of the valve assembly at one end, and forms a high-pressure outlet of the valve assembly at the other end, the low-pressure solenoid valve is in communication with the high-pressure outlet at one end, and forms a low-pressure outlet of the valve assembly at the other end, the high-pressure inlet is in communication with the exhaust port of the compressor directly or indirectly, the high-pressure outlet is in communication with the corresponding outdoor heat exchange unit, and the low-pressure outlet is in communication with the low-pressure gas line.

The outdoor unit further includes a four-way refrigeration valve, a D end of the four-way refrigeration valve is in communication with the exhaust port of the compressor, an S end of the four-way refrigeration valve is in communication with the low-pressure gas line, a C end is in communication with one of the outdoor heat exchange units and the high-pressure inlet, respectively, and the high-pressure outlet is in communication with the other outdoor heat exchange units.

An E end of the four-way refrigeration valve is in communication with the intake port of the compressor via a throttling device, or the E end of the four-way refrigeration valve is set to be closed.

When the D end of the four-way refrigeration valve is in communication with the C end, the air conditioning system enters the cooling mode; when the D end of the four-way refrigeration valve is in communication with the E end, the air conditioning system enters the heating mode or the hybrid mode.

The first heat exchange mechanism includes generators, the generator has a fifth state in which a first refrigerant port is in communication with the high-pressure gas line via a first solenoid valve and the other end is in communication with the liquid line, and a sixth state in which the first refrigerant port is in communication with the low-pressure gas line via a second solenoid valve and the other end is in communication with the liquid line.

The first heat exchange mechanism further includes water tanks, the water tank is arranged in series with the generator to form a water tank heat exchange circulation line.

When the first solenoid valve is opened and the second solenoid valve is closed, the generator and the water tank are configured to produce household hot water, and when the second solenoid valve is opened and the first solenoid valve is closed, the generator and the water tank are configured to produce household cold water.

The first heat exchange mechanism further includes a floor heating line, and the floor heating line is arranged in series with the generator to form a floor heating heat exchange circulation line.

When the first solenoid valve is opened and the second solenoid valve is closed, the generator and the floor heating line are configured to perform floor heating.

The air conditioner indoor unit is in communication with the high-pressure gas line via a third solenoid valve and in communication with the low-pressure gas line via a fourth solenoid valve, the air conditioner indoor unit each has a first state in which one end is in communication with the liquid line and the other end is in communication with the high-pressure gas line, and a second state in which one end is in communication with the liquid line and the other end is in communication with the low-pressure gas line.

The valve assembly further includes a low-pressure bypass solenoid valve, the low-pressure bypass solenoid valve is in communication with the high-pressure outlet at one end and in communication with the low-pressure outlet at the other end.

In the air conditioning system provided by the present disclosure, the objective of cooling and heating at the same time is achieved by connecting the indoor heat exchange mechanisms for cooling and heating with an outdoor unit and using the outdoor unit to provide refrigerant in different states, and various functions, such as the air-conditioning cooling, air-conditioning heating, producing household cold water, producing household hot water, and home heating are integrated by setting the water generator heat exchange mechanism and the air conditioner indoor unit, thereby conserving space and facilitating installation. Moreover, the system directly utilizes high-temperature refrigerant to heat water for floor heating, which replaces coal heating and boiler heating, conserves energy, and is environmentally friendly to a greater degree, thereby improving the living environment.

BRIEF DESCRIPTION OF THE DRAWINGS

FIG. 1 is a schematic diagram showing a structure of an air conditioning system according to an embodiment of the present disclosure.

DETAILED DESCRIPTION

In order to make the objectives, technical solutions, and advantages of the present disclosure clearer, the present disclosure is described below in detail with reference to the accompanying drawings and embodiments. It should be understood that the specific embodiments described herein are only used to explain the present disclosure, but not intended to limit the present disclosure.

The air conditioning system as shown in FIG. 1 includes an outdoor unit 1 and an indoor heat exchange mechanism 2. The indoor heat exchange mechanism 2 includes air conditioner indoor units 21 and a first heat exchange mechanism 3 for at least one of water cooling, water heating, and heating. The indoor heat exchange mechanism 2 is in communication with the outdoor unit 1 via a liquid line 4, a high-pressure gas line 5, and a low-pressure gas line 6. The air conditioning system has a cooling mode in which the indoor heat exchange mechanism 2 only for cooling is turned on, a heating mode in which the indoor heat exchange mechanism 2 only for heating is turned on, and a hybrid mode in which the indoor heat exchange mechanism 2 for cooling and the indoor heat exchange mechanism 2 for heating are both turned on. The amount of refrigerant distributed to the liquid line 4, the high-pressure gas line 5 and the low-pressure gas line 6 in the outdoor unit 1 can be switched according to the operating mode of the air conditioning system to meet the needs of the indoor heat exchange mechanism 2. The air conditioner indoor unit 21 can be used for cooling as well as heating. The first heat exchange mechanism 3 utilizes refrigerant to exchange heat with water, so as to achieve the objective of producing hot water, producing cold water, or floor heating.

The outdoor unit 1 includes a compressor 11, two outdoor heat exchange units 12, and a valve assembly 13. The high-pressure gas line 5 is in communication with the exhaust port of the compressor 11, and the low-pressure gas line 6 is communication with the intake port of the compressor 11. One of the outdoor heat exchange units 12 has a third state in which one end is in communication with the high-pressure gas line 5 and the other end is in communication with the liquid line 4, and a fourth state in which one end is in communication with the low-pressure gas line 6 and the other end is in communication with the liquid line 4, so that the outdoor heat exchange unit 12 condenses in the third state and evaporates in the fourth state.

The other outdoor heat exchange unit 12 has a fifth state in which one end is in communication with the liquid line 4 and the other end is in communication with the high-pressure gas line 5 via the valve assembly 13, and a sixth state in which one end is in communication with the liquid line 4 and the other end is in communication with the low-pressure gas line 6 via the valve assembly 13, and the valve assembly 13 is configured to control the outdoor heat exchange unit 12 to switch between the fifth state and the sixth state. By adopting two outdoor heat exchange units 12, the operating states of the two outdoor heat exchange units 12 can be respectively adjusted according to all needs of the indoor heat exchange mechanism 2, thereby ensuring that the heat exchange area of condensation and evaporation matches the needs, and increasing the comfort of the system. The valve assembly 13 can adjust the operating state of the corresponding outdoor heat exchange unit 12, that is, three states, the outdoor heat exchange unit 12 is adjusted to be in communication with the high-pressure gas line 5 to perform condensation, or in communication with the low-pressure gas line 6 to perform evaporation, or not in communication with the high-pressure gas line 5 and the low-pressure gas line 6 to perform no operation, thereby ensuring that the compressor 11 switches the operating state of the air conditioning system without reducing frequency, and effectively reducing the noise generated in the switching process of the main valve body.

The valve assembly 13 includes a high-pressure solenoid valve 131 and a low-pressure solenoid valve 132. One end of the high-pressure solenoid valve 131 forms a high-pressure inlet of the valve assembly 13, and the other end forms a high-pressure outlet of the valve assembly 13. One end of the low-pressure solenoid valve 132 is in communication with the high-pressure outlet, and the other end forms the low-pressure outlet of the valve assembly 13. The high-pressure inlet is directly or indirectly in communication with the exhaust port of the compressor 11, the high-pressure outlet is in communication with the corresponding outdoor heat exchange unit 12, and the low-pressure outlet is in communication with the low-pressure gas line 6. The high-pressure solenoid valve 131 and the low-pressure solenoid valve 132 are used to quickly adjust the pressure value of the corresponding outdoor heat exchange unit 12 to reduce the pressure value that needs to be overcome during the switching process of the main valve body, so that the compressor 11 does not need to perform a frequency reduction operation, and it is ensured that the main valve body will not generate excessive noise when it is in the switching process.

The outdoor unit 1 further includes a four-way refrigeration valve 14. The D end of the four-way refrigeration valve 14 is in communication with the exhaust port of the compressor 11, and the S end of the four-way refrigeration valve 14 is in communication with the low-pressure gas line 6, the C end is respectively in communication with one of the outdoor heat exchange unit 12 and the high-pressure inlet, and the high-pressure outlet is in communication with the other outdoor heat exchange unit 12. The powering up and powering down of the four-way refrigeration valve 14 are utilized to switch the communication mode of the four-way refrigeration valve 14, so as to achieve the objective of switching the operating states of the two outdoor heat exchangers of the air conditioning system, thereby facilitating the adjustment of the amount of refrigerant in the liquid line 4, the high-pressure gas line 5, and the low-pressure gas line 6, so as to meet all needs of the indoor heat exchange mechanism 2.

The E end of the four-way refrigeration valve 14 is in communication with the intake port of the compressor 11 via a throttle device, or the E end of the four-way refrigeration valve 14 is set to be closed, that is, when the S end of the four-way refrigeration valve 14 is in communication with the C end, refrigerant does not flow into the intake port of the compressor 11 via the E end due to the effect of the throttle device or the closed setting.

When the D end of the four-way refrigeration valve 14 is in communication with the C end, the air conditioning system enters the cooling mode, so that most of the refrigerant in the compressor 11 enters the outdoor heat exchanger for heat exchange, thereby increasing the amount of refrigerant in the liquid line 4, so as to enable the indoor heat exchange mechanism 2 to perform cooling. When the D end of the four-way refrigeration valve 14 is in communication with the E end, the air conditioning system enters the heating mode or the hybrid mode, that is, most of the refrigerant enters the high-pressure gas line 5, thereby increasing the amount of refrigerant and the temperature of the refrigerant in the high-pressure gas line 5, so as to enable the indoor heat exchange mechanism 2 to perform heating, and the refrigerant in the high-pressure gas line 5 passes through and exchanges heat with the indoor heat exchange mechanism 2, which are configured for heating, to form liquid refrigerant, and the liquid refrigerant enters the liquid line 4, so that the liquid refrigerant in the liquid line 4 can enter the indoor heat exchange mechanism 2, which are configured for cooling, to perform cooling, thereby realizing cooling and heating at the same time. Various needs can be met at the same time according to different setting of the indoor heat exchange mechanism 2 (for example, including water heating mechanism, water cooling mechanism, floor heating, etc. at the same time).

The first heat exchange mechanism 3 includes generators 31. The generator 31 has a fifth state in which a first refrigerant port is in communication with the high-pressure gas line 5 via a first solenoid valve and the other end is in communication with the liquid line 4, and a sixth state in which the first refrigerant port is in communication with the low-pressure gas line 6 via a second solenoid valve and the other end is in communication with the liquid line 4, that is, the state of refrigerant entering the generator 31 is selected by switching the first solenoid valve and the second solenoid valve. When the first solenoid valve is opened, a high-temperature and high-pressure refrigerant is introduced into the generator 31 for producing hot water or heating. When the second solenoid valve is opened, a liquid refrigerant is introduced into the generator 31 for producing cold water or cooling. In particular, the operating states of the first solenoid valve and the second solenoid valve are opposite.

The first heat exchange mechanism 3 further includes water tanks 32, and the water tank 32 is arranged in series with the generator 31 to form a water tank heat exchange circulation line.

When the first solenoid valve is opened and the second solenoid valve is closed, the generator 31 and the water tank 32 are configured to produce household hot water, and when the second solenoid valve is opened and the first solenoid valve is closed, the generator 31 and the water tank 32 are configured to produce household cold water.

The first heat exchange mechanism 3 further includes a floor heating line 33, and the floor heating line 33 is arranged in series with the generator 31 to form a floor heating heat exchange circulation line.

When the first solenoid valve is opened and the second solenoid valve is closed, the generator 31 and the floor heating line 33 are configured to perform floor heating.

The air conditioner indoor unit 21 is in communication with the high-pressure gas line 5 via a third solenoid valve, and in communication with the low-pressure gas line 6 via a fourth solenoid valve. The air conditioner indoor unit 21 each has a first state in which one end is in communication with the liquid line 4 and the other end is in communication with the high-pressure gas line 5, and a second state in which one end is in communication with the liquid line 4 and the other end is in communication with the low-pressure gas line 6. When the third solenoid valve is opened and the fourth solenoid valve is closed, the air conditioner indoor unit 21 performs heating, and when the third solenoid valve is closed and the fourth solenoid valve is opened, the air conditioner indoor unit 21 performs cooling.

The valve assembly 13 also includes a low-pressure bypass solenoid valve 133. One end of the low-pressure bypass solenoid valve 133 is in communication with the high-pressure outlet, and the other end is in communication with the low-pressure outlet. The low-pressure bypass solenoid valve 133 is arranged to relieve the pressure gradually, so as to increase the efficiency of pressure relief and increase the switching success rate of the four-way valve during the switching process, while ensuring the reliability of the connecting tubes, connecting ports, and other positions of the air conditioning system.

For example, take the indoor heat exchange mechanism 2 in FIG. 1 as an example, the indoor heat exchange mechanism 2 includes two air conditioner indoor units 21, a water cooling mechanism, a water heating mechanism, and a floor heating line 33;

1. When the air conditioning system has indoor cooling demand, water cooling demand, or both, the operating state of the outdoor unit is the same: the four-way refrigeration valve 14 is powered down (the D end of the four-way refrigeration valve 14 is in communication with the C end), the outside heat exchanger acts as a condenser to cool the high-temperature and high-pressure gas into a low-temperature and high-pressure liquid, after being throttled by the outdoor unit EEV, the low-temperature and high-pressure liquid becomes a low-temperature and low-pressure liquid and enters the mode converter via the liquid line 4.

After the refrigerant enters the mode converter, for the branch with air conditioner indoor unit for cooling and the branch with water cooling demand, the first solenoid valve (or the third solenoid valve) of the corresponding branch is in power down state, and the second solenoid valve (or the fourth solenoid valve) is in power up state. For the air conditioner indoor unit 21, the refrigerant enters the inner heat exchanger via indoor unit EEV to evaporate, and returns to the outdoor unit via the low-pressure gas line 6. For the water cooling mechanism, the refrigerant exchanges heat with water via the generator 31, and then returns to the outdoor unit. The water in the generator 31 that absorbs the energy of the refrigerant drops to the temperature we need and enters the water tank 32 for storage, which is convenient for life and practical use.

2. When the air conditioning system has indoor heating demand, water heating demand, floor heating demand, or all of the several demands, the operating state of the outdoor unit is the same: the four-way refrigeration valve 14 is powered up (the D end of the four-way refrigeration valve 14 is in communication with the E end). When the system is started, the high-temperature and high-pressure gas directly enters the mode converter via the high-pressure gas line 5.

After the high-temperature refrigerant enters the mode converter, for the air conditioner indoor unit 21 for heating and the water heating mechanism, the first solenoid valve of the corresponding branch is in power up state, and the second solenoid valve is in power down state. For the air-conditioning heating branch, the high-temperature refrigerant enters the air conditioner indoor unit 21 via the gas line for condensation, then returns to the outside heat exchanger via the liquid line 4 for evaporation, and then returns to the compressor 11. For the water heating mechanism, the high-temperature refrigerant heats the water via the generator 31, and then returns to the outside heat exchanger via the liquid line 4 after heat exchange. The water heated by the generator 31 is heated to the target temperature, and then stored in the water tank 32 for insulation for daily use. For the branch with floor heating demand, the high-temperature refrigerant is directly used to heat the water for daily heating.

3. When the air conditioning system needs to achieve functions of air-conditioning cooling, air-conditioning heating, household cold water, household hot water, and floor heating at the same time, the operating state of the outdoor unit is: the four-way refrigeration valve 14 is powered up (the D end of the four-way refrigeration valve 14 is in communication with the E end). When the system is started, the high-temperature and high-pressure gas directly enters the mode converter via the high-pressure gas line 5.

Branch 1 to branch 5 are arranged in sequence in the direction away from the outdoor unit 1 in FIG. 1:

Branch 1 (air conditioner indoor unit 21 for cooling): air-conditioning cooling: the third solenoid valve is closed, the fourth solenoid valve is powered up, the refrigerant enters the indoor unit via the liquid line 4, and returns to the outdoor unit via the low-pressure gas line 6 after heat exchange.

Branch 2 (air conditioner indoor unit 21 for heating): air-conditioning heating: the third solenoid valve is powered up, the fourth solenoid valve is powered down, the refrigerant enters the indoor unit via the high-pressure gas line 5, and after heat exchange, part of the refrigerant enters the cooling indoor unit via the liquid line 4, part of the refrigerant returns to the outdoor unit system.

Branch 3 (water heating mechanism): household hot water: the first solenoid valve is powered up, the second solenoid valve is powered down, the refrigerant enters the generator 31 via the high-pressure gas line 5, and after heat exchange, part of the refrigerant enters the cooling indoor unit via the liquid line 4, part of the refrigerant returns to the outdoor unit system. The water heated by the generator 31 is heated to the target temperature, and then stored in the water tank 32 for insulation for daily use.

Branch 4 (water cooling mechanism): household cold water: the first solenoid valve is closed, the second solenoid valve is powered up, the refrigerant enters the generator 31 via the liquid line 4, and returns to the outdoor unit via the low-pressure gas line 6 after heat exchange. The water in the generator 31 that absorbs the energy of the refrigerant drops to the temperature we need and enters the water tank 32 for storage, which is convenient for life and practical use.

Branch 5 (floor heating line 33): floor heating: the first solenoid valve is powered up, the second solenoid valve is powered down, the refrigerant enters the generator 31 via the high-pressure gas line 5, and after heat exchange, part of the refrigerant enters the cooling indoor unit via the liquid line 4, part of the refrigerant returns to the outdoor unit system, and the water in the generator 31 enters, after heat exchange, the floor heating line for daily heating use.

The above embodiments only show several implementing manners of the present disclosure, the description of the embodiments is relatively specific and detailed, but cannot be understood as a limitation to the patent scope of the present disclosure. It should be noted that, for those of ordinary skill in the art, several modifications and improvements can be made without departing from the concept of the present disclosure, and these modifications and improvements are within the protection scope of the present disclosure. Therefore, the protection scope of the present disclosure shall be subject to the appended claims.

What is claimed is:

1. An air conditioning system, comprising:

an outdoor unit;

an indoor heat exchange mechanism, configured to communicate with the outdoor unit via a liquid line, a high-pressure gas line and a low-pressure gas line, wherein the indoor heat exchange mechanism comprises an air conditioner indoor unit and a first heat exchange mechanism, and the first heat exchange mechanism comprises a first branch configured to provide water cooling, wherein the first branch is separate from one or more additional branches configured, respectively, to provide at least one of air conditioning cooling, air conditioning heating, water heating, or floor heating;

a valve assembly having a high-pressure inlet and a high-pressure outlet, wherein the outdoor unit comprises a four-way refrigeration valve, a compressor, and two outdoor heat exchange units, wherein a D end of the four-way refrigeration valve is in communication with an exhaust port of the compressor, wherein an S end of the four-way refrigeration valve is in communication with the low-pressure gas line, wherein a C end of the four-way refrigeration valve is in communication with one of the two outdoor heat exchange units and the high-pressure inlet, and the high-pressure outlet is in communication with the other of the two outdoor heat exchange units, and wherein an E end of the four-way refrigeration valve is either (i) in communication with an intake port of the compressor via a throttling device, or (ii) is closed.

2. The air conditioning system as claimed in claim 1, wherein the high-pressure gas line is in communication with the exhaust port of the compressor, wherein the low-pressure gas line is in communication with the intake port of the compressor, wherein one of the two outdoor heat exchange units has a first state in which one end is in communication with the high-pressure gas line and the other end is in communication with the liquid line, and wherein a second state in which one end is in communication with the low-pressure gas line and the other end is in communication with the liquid line.

3. The air conditioning system as claimed in claim 2, wherein the other of the two outdoor heat exchange units has a third state in which one end is in communication with the liquid line and the other end is in communication with the high-pressure gas line via the valve assembly, and a fourth state in which one end is in communication with the liquid line and the other end is in communication with the low-pressure gas line via the valve assembly, and wherein the valve assembly is configured to control the outdoor heat exchange unit to switch between the third state and the fourth state.

4. The air conditioning system as claimed in claim 3, wherein the valve assembly comprises a high-pressure solenoid valve and a low-pressure solenoid valve, the high-pressure solenoid valve forms the high-pressure inlet of the valve assembly at a first end of the high-pressure solenoid valve one end, and forms the high-pressure outlet of the valve assembly at a second end of the high-pressure solenoid valve, wherein the low-pressure solenoid valve is in communication with the high-pressure outlet at a first end of the low-pressure solenoid valve, and forms a low-pressure outlet of the valve assembly at a second end of the low-pressure solenoid valve, wherein the high-pressure inlet is in communication with the exhaust port of the compressor directly or indirectly, wherein the high-pressure outlet is in communication with the corresponding outdoor heat exchange unit, and wherein the low-pressure outlet is in communication with the low-pressure gas line.

5. The air conditioning system as claimed in claim 1, wherein the first heat exchange mechanism comprises generators, wherein the generator has a first state in which a first refrigerant port is in communication with the high-pressure gas line via a first solenoid valve and the other end is in communication with the liquid line, and a second state in which the first refrigerant port is in communication with the low-pressure gas line via a second solenoid valve and the other end is in communication with the liquid line.

6. The air conditioning system as claimed in claim 5, wherein the first heat exchange mechanism further comprises a water tank, and wherein the water tank is arranged in series with the generator to form a water tank heat exchange circulation line.

7. The air conditioning system as claimed in claim 5, wherein the first heat exchange mechanism further comprises a floor heating line, and wherein the floor heating line is arranged in series with the generator to form a floor heating heat exchange circulation line.

8. The air conditioning system as claimed in claim 1, wherein the air conditioner indoor unit is in communication with the high-pressure gas line via a first solenoid valve and in communication with the low-pressure gas line via a second solenoid valve, and wherein the air conditioner indoor unit has a first state in which one end is in communication with the liquid line and the other end is in communication with the high-pressure gas line, and a second state in which one end is in communication with the liquid line and the other end is in communication with the low-pressure gas line.

9. The air conditioning system as claimed in claim 4, wherein the valve assembly further comprises a low-pressure bypass solenoid valve, and wherein the low-pressure bypass solenoid valve is in communication with the high-pressure outlet at one end and in communication with the low-pressure outlet at the other end.

* * * * *